US006565272B2

(12) United States Patent
Kelley et al.

(10) Patent No.: US 6,565,272 B2
(45) Date of Patent: May 20, 2003

(54) COMPLIANT CARRIAGE ADJUSTMENT METHOD AND APPARATUS FOR SETTING DEFAULT PRINTHEAD-TO-MEDIA-SPACING IN A PRINTER

(75) Inventors: Richard A. Kelley, Vancouver, WA (US); David Burton, Vancouver, WA (US); Wade A. Powell, Vancouver, WA (US); Elmer S. Cajigas, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 35 days.

(21) Appl. No.: 09/940,295

(22) Filed: Aug. 27, 2001

(65) Prior Publication Data

US 2003/0039500 A1 Feb. 27, 2003

(51) Int. Cl.[7] ..... B41J 25/308
(52) U.S. Cl. ..... 400/59; 400/55; 347/8
(58) Field of Search ..... 400/55, 56, 57, 400/59; 347/8

(56) References Cited

U.S. PATENT DOCUMENTS

| | | | | | |
|---|---|---|---|---|---|
| 4,657,415 | A | * | 4/1987 | Kikuchi et al. | 400/59 |
| 5,000,590 | A | * | 3/1991 | Einem | 400/55 |
| 5,815,171 | A | * | 9/1998 | Brugue | 347/8 |
| 5,975,778 | A | * | 11/1999 | Kanemitsu | 400/352 |
| 6,027,264 | A | | 2/2000 | Maher et al. | |
| 6,394,568 | B1 | | 5/2002 | Menendez | |

* cited by examiner

*Primary Examiner*—Andrew H. Hirshfeld
*Assistant Examiner*—Dave A. Ghatt

(57) ABSTRACT

The present invention provides an apparatus for adjusting and fixing default printhead-to-media spacing in a printer having a frame and a printhead-carrying carriage, the apparatus including an elongate, laterally extending carriage rod along which the carriage moves during printing, and selectively adjustable and fixable compliant structure mounting the rod on the frame, and operable to effect positional and fixable adjustment of the rod relative to the frame to establish a desired default printhead-to-media spacing.

6 Claims, 2 Drawing Sheets

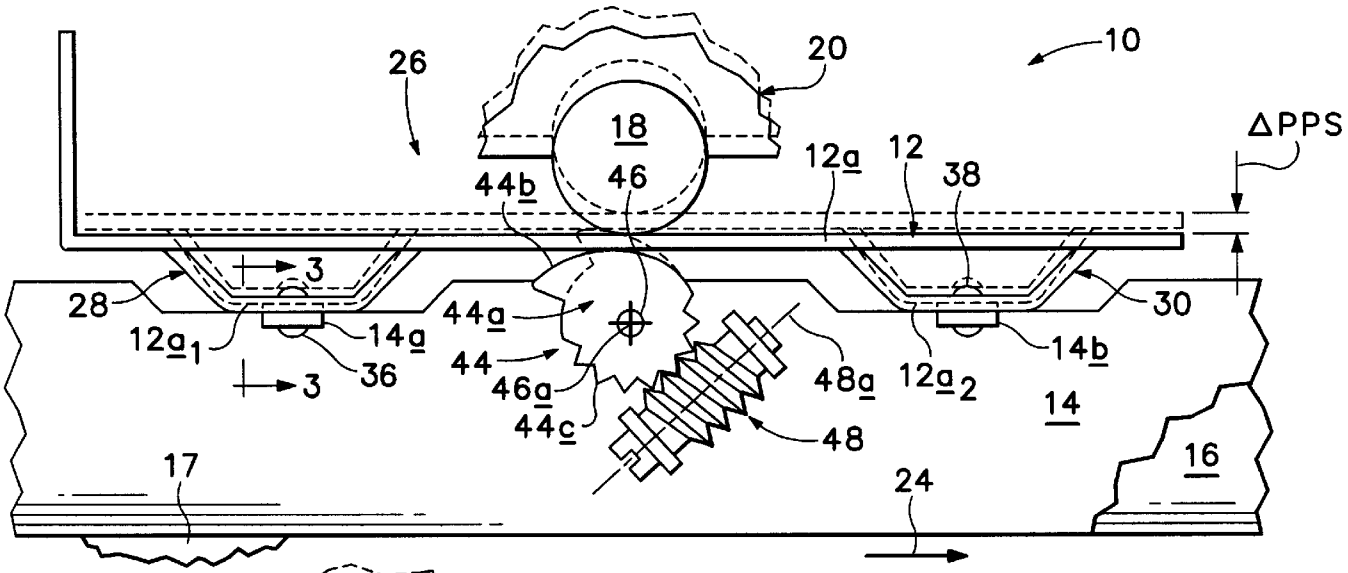
FIG.2
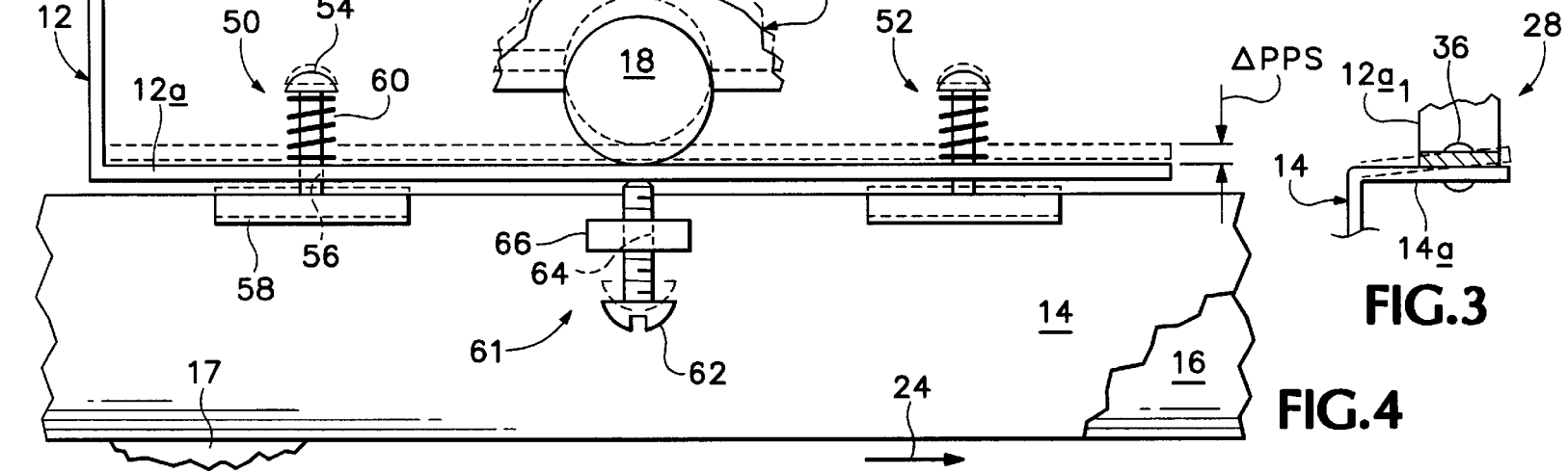
FIG.3
FIG.4

COMPLIANT CARRIAGE ADJUSTMENT METHOD AND APPARATUS FOR SETTING DEFAULT PRINTHEAD-TO-MEDIA-SPACING IN A PRINTER

TECHNICAL FIELD

The present invention relates to printers, and in particular, to a method and apparatus utilizing compliant structure for adjusting and fixing default printhead-to-media spacing in a printer.

BACKGROUND ART

In inkjet printers, carriages which carry printheads, and the support structures for such carriages, are typically arranged during the manufacturing process to define for printheads a preset, operational, default printhead-to-media spacing. Such a spacing positions a supported printhead at a predetermined appropriate elevation above a path along which print media moves through a printer. This elevation normally is set to accommodate the printing of single sheets of media typically having about a 20-lb. bond-weight thickness.

Whatever default spacing is specifically chosen, it is desirable that this spacing be easily established (adjusted and fixed) at the time of manufacture, and thereafter stable during shipment and normal use. Achieving such ease of setting, along with long-term stability and overall simplicity, have been focal points of attention in the prior art.

DISCLOSURE OF THE INVENTION

The present invention provides an apparatus for adjusting and fixing default printhead-to-media spacing in a printer having a frame and a printhead-carrying carriage. The apparatus includes an elongate, laterally extending carriage rod along which the carriage moves during printing, and selectively adjustable and fixable compliant structure mounting the rod on the frame, and operable to effect positional and fixable adjustment of the rod relative to the frame to establish a desired default printhead-to-media spacing.

BRIEF DESCRIPTION OF THE DRAWINGS

FIG. 2 is a slightly larger-scale fragmentary view, taken generally along the line 2—2 in FIG. 1.

FIG. 3 is a somewhat further enlarged fragmentary cross-sectional view taken generally along the line 3—3 in FIG. 2.

FIG. 4 is a view which is very much like that presented in FIG. 2, but here showing an alternative embodiment of the present invention.

DETAILED DESCRIPTION AND BEST MODE FOR CARRYING OUT AND PRACTICING THE INVENTION

Figure 1:
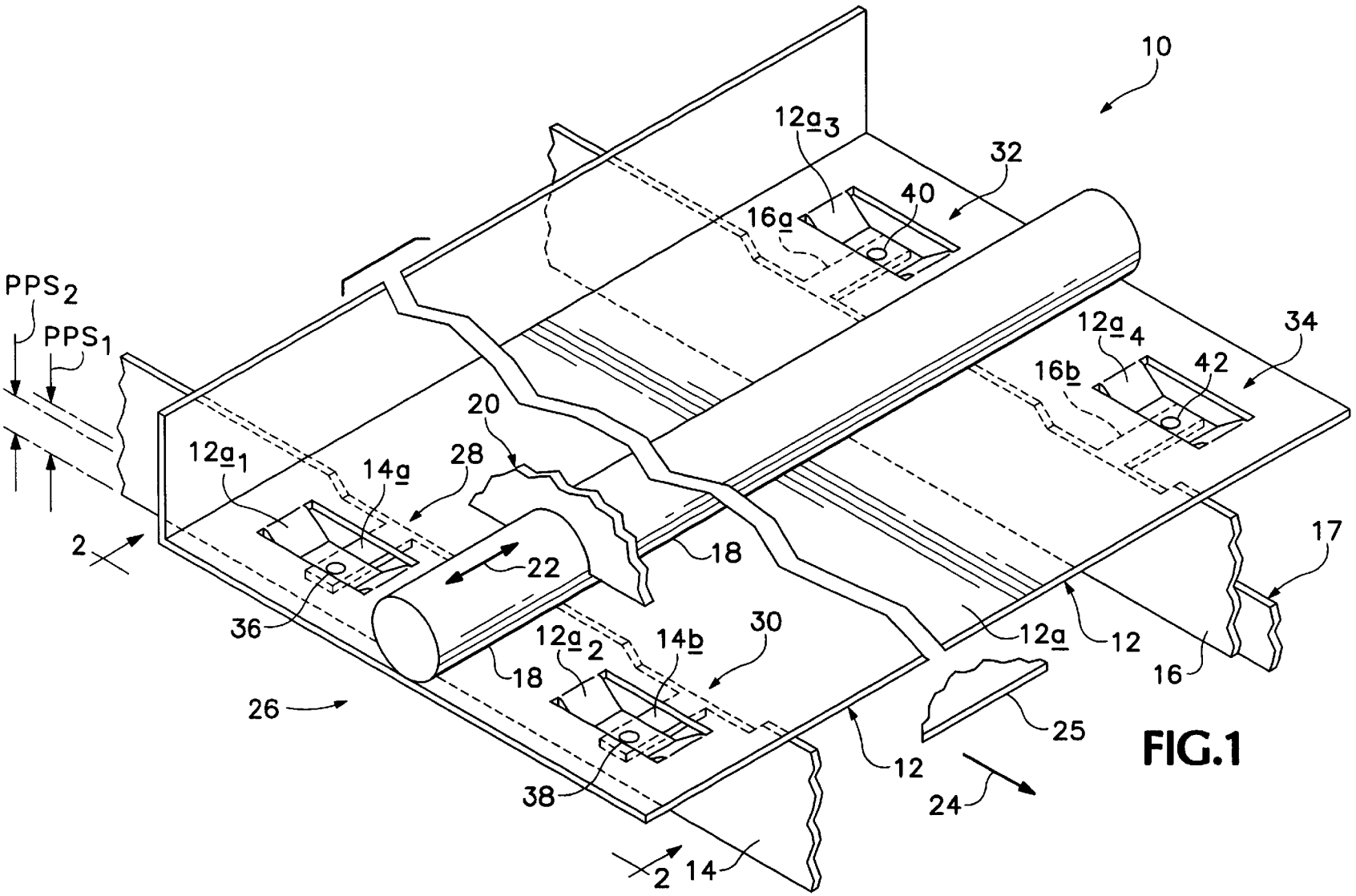
FIG. 1 is a fragmentary top isometric view illustrating portions of an inkjet printer which employs, and operates in accordance with, one embodiment of compliant structure made pursuant to the present invention.

Turning attention now to the drawings, and referring first of all to FIGS. 1, 2 and 3, indicated generally at 10 are portions of a printer that includes one embodiment of the present invention. Present within printer 10 are a carriage plate 12, and a pair of laterally spaced frame components 14, 16 that form part of the frame 17 (see FIG. 1) in printer 10.

Also included are an elongate, generally cylindrical carriage rod 18, and a carriage 20 (see FIG. 2). Rod 18 is suitably anchored to the top of carriage plate 12, and carriage 20, during operation of the printer, rides back and forth on rod 18 as indicated by double-ended arrow 22.

Carriage 20 may be conventional in construction, and may be designed to support one or more conventional inkjet printheads (not shown) for printing onto media below which is transported through the printer generally in the direction of arrow 24. Arrow 24 lies in the plane of the media travel path, and a fragment of single-sheet media is shown at 25 in FIG. 1. Schematically illustrated at the left side of FIG. 1 are two different default printhead-to-media (also known as "printhead-to-paper") spacings $PPS_1$ and $PPS_2$. $PPS_1$ is greater than $PPS_2$.

The apparatus and method of the present invention are aimed toward permitting adjustment and fixing of the nominal, or default, printhead-to-media spacing (PPS) in printer 10. Accordingly, printer 10 further includes compliant structure 26 which is made in accordance with the present embodiment of the invention. Compliant structure 26 includes four compliant substructures designated 28, 30, 32, 34. Each of these compliant substructures includes the same structural elements, and in each case, these structural elements include portions both of carriage plate 12 and of one of frame components 14 or 16.

Referring specifically now to these four compliant substructures, carriage plate 12 includes a generally horizontal and planar, rectangular sheet metal bed 12*a* having, adjacent its four corners, four elongate, displaced, out-of-plane, angular and resilient sheetmetal strips, such as those shown at $12a_1$, $12a_2$, $12a_3$, $12a_4$. Strips $12a_1$, $12a_2$, $12a_3$, $12a_4$ are anchored through fasteners 36, 38, 40, 42, respectively, to resilient cantilevered sheetmetal tabs 14*a*, 14*b*, 16*a*, 16*b*, respectively, that are formed at the respective locations shown in frame components 14, 16, respectively.

Disposed on the opposite lateral sides of the frame in printer 10, just outward of the outwardly-facing sides of frame members 14, 16, are two similar compliant adjustment mechanisms, only one of which is shown at 44 in FIG. 2. Accordingly, describing both of these mechanisms by describing mechanism 44, the latter includes a cam 44*a* which is rotatably mounted on a shaft 46 for rotation about the long axis 46*a* of the shaft. Shaft 46 is fixed relative to frame components 14 and 16. Cam 44*a* includes a cam surface 44*b* that bears on the underside of the carriage plate, and perimeter teeth, such as teeth 44*c*, which are drivingly engaged with a worm-like drive screw, or cam driver, 48. Screw 48 is suitably supported for turning about its long axis 48*a* on the outer side of frame component 14, and its threads are drivingly engaged with teeth 44*c*.

Adjustment mechanism 44 is directly associated with substructures 28, 30. The other adjustment mechanism (which is not shown) is directly associated with compliant substructures 32, 34.

To adjust and then fix a desired, default printhead-to-media spacing in printer 10, at the time of printer manufacture, screw 48, and its counterpart in the non-illustrated adjustment mechanism, is turned to rotate cam 44*a*, thus to drive upwardly on the underside of the carriage plate. Typically, in the absence of any engagement existing between the cam and carriage plate bed 12*a*, PPS is smaller than the desired default value. Such an arrangement assures proper operability of the compliant structure of the present invention to control and set default PPS. This action shifts the elevation of carriage rod 18 vertically in the printer, and such shifting accomplishes the desired PPS adjustment. Such adjustment is both permitted and resisted by elastic compliant that exists in sheet metal strips 12$a_1$, 12$a_2$, 12$a_3$, 12$a_4$, and in tabs 14*a*, 14*b*, 16*a*, 16*b*. In solid outline in FIGS. 1 and 2, the carriage plate is shown adjusted to one condition to establish one printhead-to-media spacing. In dashed lines in FIG. 2, the carriage plate is shown shifted upwardly relative to frame components 14, 16. The difference in adjusted PPS represented by these two conditions is represented in FIG. 2 by the designator ΔPPS.

On completion of adjustment, the "force-loaded" condition which then exists between the printer frame and the carriage plate, via substructures 28, 30, 32, 34 and the adjustment mechanisms, such as mechanism 44, creates a condition of substantial vertical positional stability for the carriage in printer 10, and hence for the established PPS. Very conveniently, the preferred form of compliant adjustment structure employs components that also form parts of a carriage plate and of a printer's frame.

FIG. 4 illustrates a modified embodiment and practice of the invention in printer 10, wherein carriage plate 12 is supported in a floating fashion above frame components 14, 16. More specifically, generally at the locations where compliant substructures 28, 30, 32, 34 are shown in FIG. 1, here there are four adjustable screw and compression coil-spring mechanisms, such as the two shown at 50, 52 in FIG. 4. Each of these mechanisms is substantially the same in construction. Therefore, describing them all in relation to mechanism 50, mechanism 50 includes a screw 54 which extends downwardly through a suitable accommodating opening 56 in carriage plate bed 12*a*. The lower threaded end in screw 54 is screwed into a cantilevered, resiliently deflectable sheetmetal tab 58 that extends laterally outwardly (toward the viewer in FIG. 4) from frame component 14. A compression coil-spring 60 acts between the upper surface of carriage plate bed 12*a* and the underside of the head in screw 54, as shown.

Located centrally intermediate mechanisms 50, 52, and disposed generally beneath carriage rod 18, is a screw adjustment mechanism 61. Mechanism 61 includes an upwardly directed screw 62 which is threadably received in a bore 64 provided in a sheetmetal tab 66 that is joined to, and also that extends from, frame component 14, in a cantilevered fashion toward the viewer in FIG. 4. The upper end of screw 62 bears on the underside of the carriage plate bed. A similar screw adjustment arrangement (not shown) is provided on the other side of the frame and carriage plate bed.

By adjusting screws, like screw 62, the carriage plate (and thus the supported carriage) can be shifted upwardly and downwardly against the actions of the compression springs, like spring 60 and the cantilevered tabs, like tab 58. In this manner, PPS can be adjusted and set to create a selected default printhead-to-media spacing. In solid lines and in dashed lines in FIG. 4, two different adjusted conditions are generally illustrated for carriage bed 12*a*, and thus for PPS. The difference in these two conditions is indicated by the designator ΔPPS. Compliant behavior here is largely attributable to the floating nature of the carriage in relation to, and in cooperation with, compressability of the coil springs and deflections in the tabs, like tab 58. With appropriate choice made for the robustness of the coil springs, a finally adjusted PPS spacing is quite stable.

INDUSTRIAL APPLICABILITY

Printer carriages that support printheads typically are themselves supported for operation on a carriage plate and/or rod that effectively defines the default printhead-to-media spacing in the printer. The present invention proposes the implementation and use, effectively intermediate a printer frame and a supported carriage, of an adjustable compliant structure that is adjustable very simply during manufacture to define and fix a selectable, stable default PPS. This compliant structure conveniently includes a portion of the carriage plate and of the frame in a printer. It may also take the form of a modified structure, including adjustable-compression springs that are interposed the carriage plate and the printer frame.

We claim:

1. Apparatus for adjusting and fixing the default printhead-to-media spacing in a printer having a frame and a printhead-carrying carriage, the apparatus comprising:

an elongate, laterally extending carriage rod along which the carriage moves during printing, and selectively adjustable and fixable compliant structure mounting the rod on the frame, and operable to effect positional and fixable adjustment of the rod relative to the frame to establish a desired default printhead-to-media spacing, wherein said compliant structure includes a carriage plate which carries the rod and which includes a deformable portion, a frame component that forms part of the frame and which includes a deformable portion joined to the carriage plate's deformable portion, and selectively fixable adjustment mechanism operatively interposed said carriage plate and said frame component for creating and fixing a selected deformation in the two joined deformation portions, thus to adjust the positional relationship existing between the frame and the rod.

2. The apparatus of claim 1, wherein the carriage plate is formed of sheet material, the deformable portion therein includes an elongate strip of such material, and the deformable portion in the frame component takes the form of a cantilevered length of material.

3. The apparatus of claim 1, wherein said adjustment mechanism includes a cam which bears against the carriage plate, and a drive screw which is drivingly engaged with said cam and interposed the cam and the frame component.

4. Apparatus for adjusting and fixing the default printhead-to-media spacing in a printer having a frame and printhead-carrying carriage, the apparatus comprising:

an elongate, laterally extending carriage rod along which the carriage moves during printing, a carriage plate supporting the rod and including a deformable strip of material, a frame component forming part of the frame and including a deformable strip of material fastened to the carriage plate's deformable strip of material, a cam rotatably mounted on the frame component and engaged with the carriage plate, wherein rotation of the cam creates related, selectively changeable deformations in the two fastened deformable strips of material, which deformations produce related different values of printhead-to-media spacing through creating related different positional relationships between the carriage rod and the frame, and a selectively adjustable and fixable cam driver operatively interposed the cam and the frame component, operable to rotate and fix the position of the cam.

5. The apparatus of claim 4, wherein the carriage plate further includes a second deformable strip of material spaced from the first-mentioned carriage-plate strip, the frame component further includes a second deformable strip of material which is spaced from the first-mentioned frame-component strip and fastened to the second-mentioned carriage-plate strip, and the cam and the driver are disposed spatially intermediate the two pairs of co-fastened strips.

6. A method for adjusting and fixing the default printhead-to-media spacing in a printer having a frame and a relatively movable printhead-carrying carriage, and wherein relative movement is accommodated between the frame and the carriage which affects printhead-to-media spacing, the method comprising the steps of:

interposing an adjustably fixable compliant structure operatively between the frame and the carriage, wherein said interposing includes furnishing, operatively intermediate the frame and the carriage, a pair of elongate deformable co-fastened strips of sheet material, and said selective adjusting and fixing comprises creating and fixing a selected condition of deformation in such strips; and selectively adjusting and fixing the compliant structure to establish a desired printhead-to-media spacing.

* * * * *